United States Patent [19]

Schmitt et al.

[11] Patent Number: 4,469,577

[45] Date of Patent: Sep. 4, 1984

[54] MEMBRANE ELECTROLYSIS CELL

[75] Inventors: Helmut Schmitt, Dortmund; Helmuth Schurig, Holzwickede; Wolfgang Strewe, Dortmund, all of Fed. Rep. of Germany

[73] Assignee: Uhde GmbH, Dortmund, Fed. Rep. of Germany

[21] Appl. No.: 498,009

[22] Filed: May 25, 1983

[30] Foreign Application Priority Data

May 26, 1982 [DE] Fed. Rep. of Germany ..... 3219704

[51] Int. Cl.[3] ..... C25B 9/02; C25B 11/03

[52] U.S. Cl. ..... 204/252; 204/258; 204/282; 204/288

[58] Field of Search ..... 204/256, 258, 266, 282, 204/283, 252–255, 257, 288, 289

[56] References Cited

U.S. PATENT DOCUMENTS

| | | | |
|---|---|---|---|
| 3,661,756 | 5/1972 | Spoon | 204/286 |
| 3,875,040 | 4/1975 | Weltin et al. | 204/267 |
| 4,013,525 | 3/1977 | Emsley | 204/98 |
| 4,013,535 | 3/1977 | White | 204/252 |
| 4,013,537 | 3/1977 | White | 204/256 |
| 4,175,025 | 11/1979 | Creamer et al. | 204/253 |
| 4,211,628 | 7/1980 | Obata et al. | 204/252 |
| 4,313,812 | 2/1982 | Kircher | 204/253 |

FOREIGN PATENT DOCUMENTS

| | | | |
|---|---|---|---|
| 2845832 | 4/1979 | Fed. Rep. of Germany | 204/282 |
| 6401763 | 8/1964 | Netherlands | 204/266 |
| 668618 | 3/1952 | United Kingdom | 204/284 |

*Primary Examiner*—Howard S. Williams
*Assistant Examiner*—T. L. Williams
*Attorney, Agent, or Firm*—Fraser, Barker, Purdue & Clemens

[57] ABSTRACT

The invention relates to a membrane electrolysis cell of the filter press type with one or more plate-type electrode pairs, each comprising at least one non-continuous active central part, with a membrane provided between the electrode pairs, and with a seal installed between each electrode and membrane rim. The membrane cell is suitable for the production of an aqueous alkali metal hydroxide solution (cell liquor) as well as of halogen and hydrogen by electrolyzing an aqueous halide-bearing electrolyte (brine).

The non-continuous central part of the electrodes has a grid-type structure, the grid rods of the electrode pairs are staggered by a maximum of half the rod width, the grid rods of the electrodes are arranged so that their interspace is smaller than the projection of their width, the grid rods have a convex face at least on the active side, and the thickness of the seals between the electrode and membrane rims is equal or inferior to the height of the grid rod portion protruding over the electrode rim.

3 Claims, 4 Drawing Figures

MEMBRANE ELECTROLYSIS CELL

BACKGROUND OF THE INVENTION

The invention relates to a membrane electrolysis cell of the filter press type with one or more plate-type electrode pairs each comprising at least one non-continuous active central part, with a membrane provided for between the electrode pair(s), and with a seal installed between each electrode and membrane rim. The membrane cell is suitable for the production of an aqueous alkali metal hydroxide solution (cell liquor) as well as of halogen and hydrogen by electrolyzing an aqueous halide-bearing electrolyte (brine).

Such an electrolysis cell is already described in DE-OS No. 2809 332. According to this description the filter-press-type electrolysis cell consists of a great number of vertically arranged alternating flexible anode and cathode plates with a cation-permeable membrane installed between adjacent anode and cathode plates. Non-conductive flexible spacer plates are provided for keeping the anode plates, the membrane, and the cathode plates in place. The thickness of the spacer plates which are either coated with sealing material or consisting completely of an almost uncompressible sealing material has been chosen so that the membrane is freely located between the anode and cathode plates. As the anode and cathode plates are thin, i.e. of low surface stability, their distance across the active area towards the membrane is irregular. The consequence is a varying distance between anode and cathode plate and thus a varying surface load (voltage drop, electrochemical efficiency). Moreover, it is difficult to perfectly stretch the membrane from the cell border to maintain smoothness thereof during operation. In addition to a possible waviness of the anode and cathode plates, an imperfect smoothness of the membrane might then have to be faced so that the space between the anode and cathode plates would not exhibit absolutely uniform distances and conditions.

The object of the present invention is to create a monopolar filter-press-type cell which in comparison with those already known offers improved properties.

SUMMARY OF THE INVENTION

The present invention covers a membrane electrolysis cell of the filter press type with one or more plate-type electrode pairs each comprising at least one non-continuous active central part, with a membrane provided for between the electrode pairs, and with a seal installed between each electrode and membrane rim characterized in that the non-continuous central part of the electrodes has a grid-type structure, that the grid rods of the electrode pairs are staggered by a maximum of half the rod width, that the grid rods of the electrodes are arranged so that their interspace is smaller than the projection of their width; the grid rods have a convex face at least on the active side; and the thickness of the seals between the electrode and membrane rims is equal or less than the height of the grid rod portion protruding over the electrode rim.

As the membrane itself acts as a seal, a further kind of realization of this invention might consist in combining the two seals arranged between the electrode and membrane rims to a single seal located between one membrane and one electrode rim of an electrode pair having a thickness equal or less than double the height of the grid rod portion protruding over the electrode rim. In this way, the number of the component parts of a filter-press-type membrane electrolysis cell could be reduced and thereby the number of sealing surfaces and of possible leakages.

According to a further embodiment of this invention, the grid rods are punched and shaped from the electrode plate.

In order to safely draw off the electrolysis product formed, such as hydrogen gas and chlorine, towards the top, the grid rods are provided on the convex-shaped face with numerous transverse grooves.

The special advantages obtained with this invention are that the distance between the electrode plates and the membrane becomes zero and that the voltage drop in the entire electrolysis cell plant is thus substantially reduced. It is not necessary, as was before, to install elaborate supporting structures for perfectly stretching the membrane and maintaining it smooth during operation.

The absence of such supporting structures entails the gas evacuation from the cell being improved and the overall length of each electrolysis cell being simultaneously reduced.

Moreover, the convex shape of the grid rods on the membrane-facing side and their staggering by a maximum of half the rod width offer the advantage that in the convex area the distance of the rods between the anode and cathode plates is constant thus creating a highly efficient electrode surface.

On the side opposite the active section the grid rods of the electrode plates may be of any form, even welded to or otherwise fixed on the electrode plate. Decisive for the final design will be considerations as regards material selection, cost of manufacture, and voltage drop in the electrolysis cell.

The electrode plates, i.e. anode and cathode plates, are made from a material or are coated according to the latest advances in technology. The seals used are also chosen in line with the latest developments as to their design and material selection. The electrolysis cell end plates and the necessary tension rods are of conventional design. Each electrode pair is equipped with terminal strips for connecting the positive and negative pole.

The present invention is especially suitable for membrane cells used for the production of chlorine and sodium hydroxide by electrolyzing aqueous sodium chloride solutions.

BRIEF DESCRIPTION OF THE DRAWINGS

Other objects and advantages of the invention will become clearly manifest to those skilled in the art from reading the following detailed description of a preferred embodiment of the invention when considered in the light of the accompanying drawings, in which.

DETAILED DESCRIPTION OF A PREFERRED EMBODIMENT OF THE INVENTION

Figure 1:
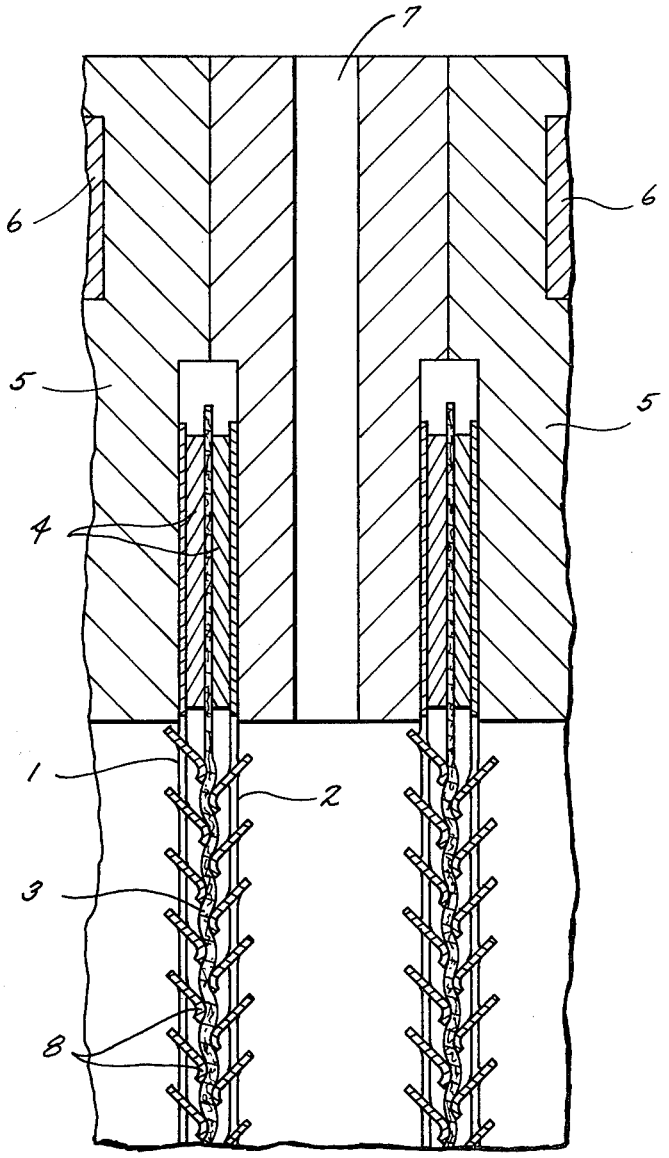
FIG. 1 is a cross-sectional view of an anode plate/-membrane/cathode plate assembly embodying the features of the invention in operating condition.

The assembly shown in FIG. 1 includes an anode plate 1 and a cathode plate 2 both being absolutely identical in structural design. A membrane 3 is disposed between the plates of seals 4 for fixing the membrane 3. Seals 5 with stiffening element 6 for obtaining a better stability are provided to maintain the assembled ends of the respective anode 1, cathode 2, membrane 3, and associated seals 4. Openings 7 for the various reaction fluids are provided between adjacent assemblies. The optimum distribution of the reaction fluid being mixed with product fluids, such as hydrogen and gaseous chlorine, and accumulating in the space between the electrode pairs is not influenced by any supporting structures whatsoever.

Figure 2:
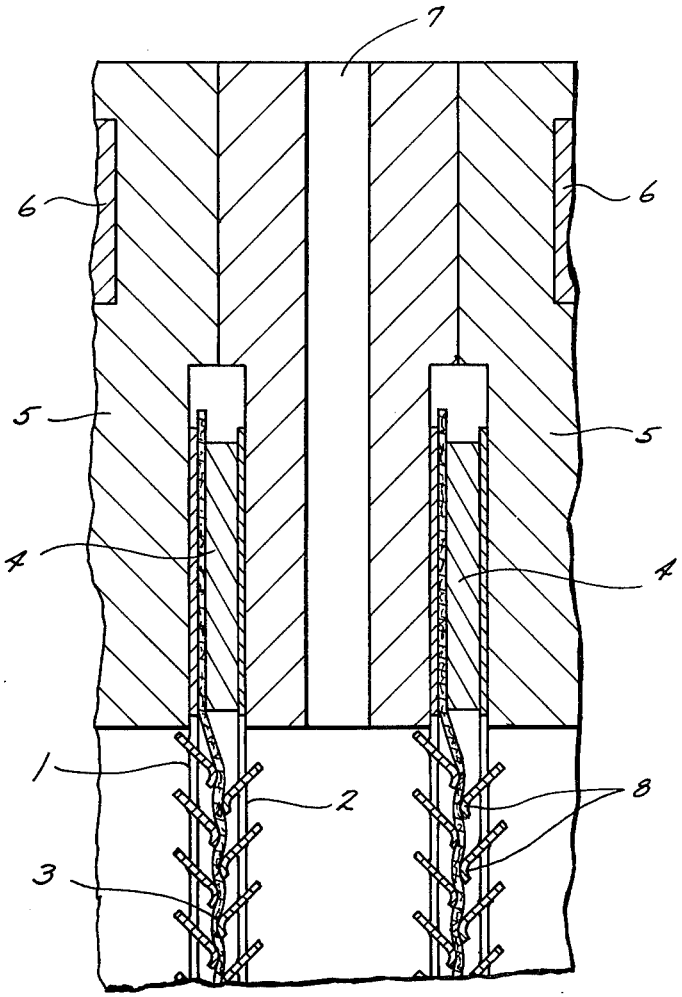
FIG. 2 is a cross-sectional view of an anode plate/-membrane/cathode plate assembly in operation condition similar to FIG. 1 with one seal only.

FIG. 2 shows an assembly similar to that illustrated in FIG. 1 wherein only a single seal 4 is employed.

Figure 3:
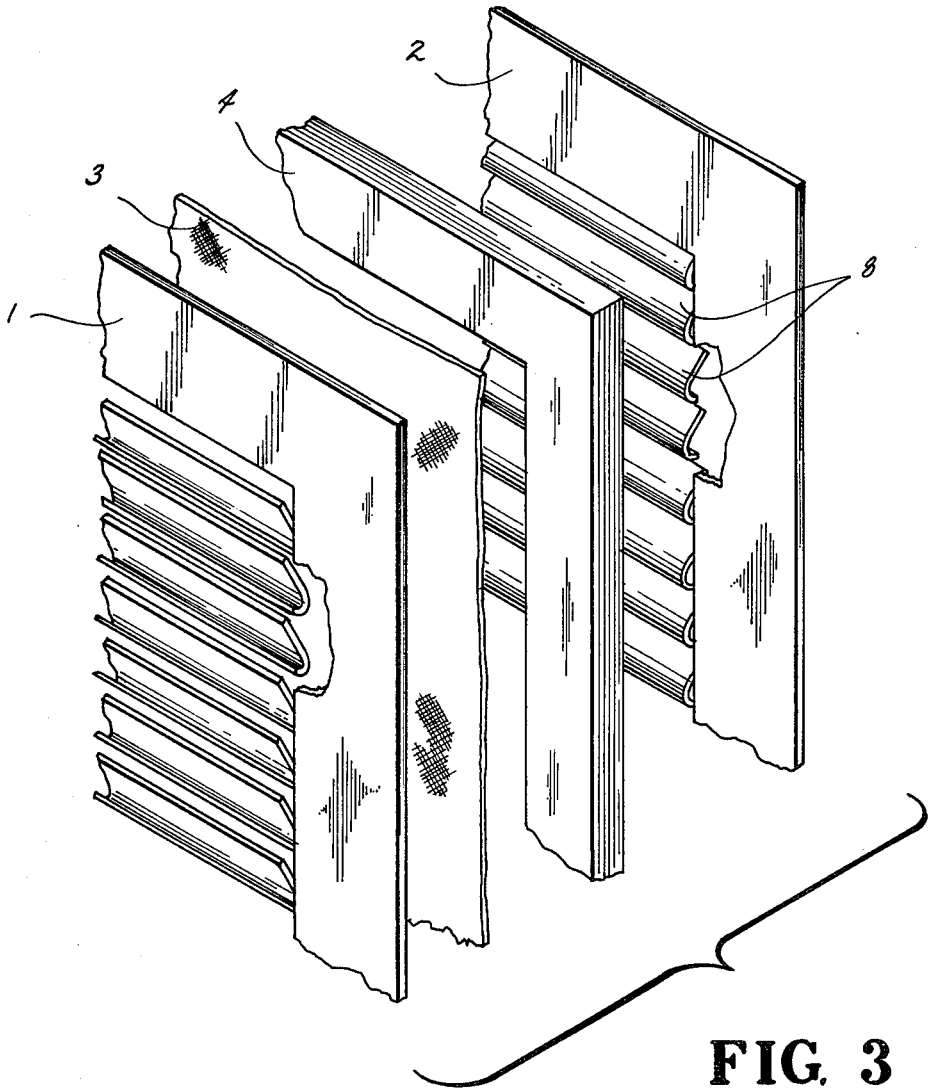
FIG. 3 is an exploded view of part of the membrane cell illustrated in FIGS. 1 and 2.

The exploded view of FIG. 3 shows the component parts of an electrolysis cell. The louver-like arrangement of the grid rods 8 which may also be designed as lamellas allows for the gaseous product fluids to escape upwards without being impeded in any way. Membrane 3 made from a commercial-grade material is fixed with seal 4 as known so that, after installation of the second electrode plate, it is located between the electrode plates as per the present invention.

Figure 4A:
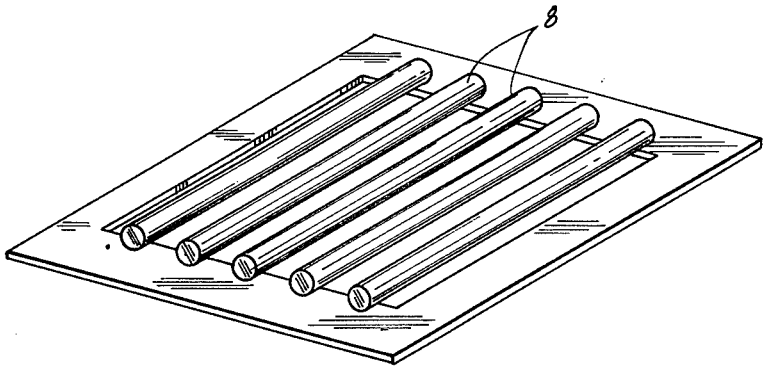
FIGS. 4*a* and 4*b* show electrode plates with grid rods of alternative shapes.
Figure 4B:
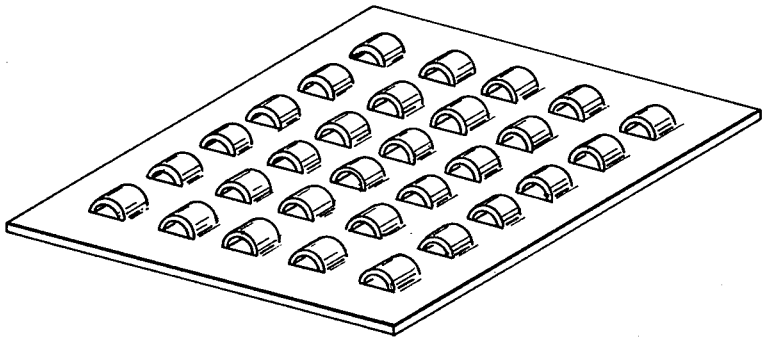

Should other designs be preferable, the grid rods chosen might be of any alternative shape as exemplified in FIGS. 4*a* and 4*b*. The essential point is that the membrane-facing side is designed according to this invention and that the grid rods of each electrode pair are staggered by a maximum of half the rod width.

We claim:

1. A filter press electrolytic cell comprising:

a pair of cooperating outer seal members having cooperating facing surfaces, the outer peripheral portions of the facing surfaces contacting one another in sealing relationship; and an electrode pair and membrane assembly having an outer peripheral portion positioned between the inner portion of the facing surfaces of said outer seal members, said electrode pair and membrane assembly including a pair of spaced apart electrode plates having a membrane element positioned therebetween, each of said electrode plates including an outer peripheral plate portion and a plurality of centrally located, spaced apart grid members integral with said outer plate portion, the outer peripheral plate portion of one of said electrode plates in sealing engagement with the inner portion of the facing surface of one of said outer seal members and the outer peripheral plate portion of the other one of said electrode plates in sealing engagement with the inner portion of the facing surface of the other one of said outer seal members, said grid members of said one of said electrode plates projecting outwardly toward said other one of said electrode plates for engagement with one side of said membrane element to urge a first portion of said membrane element toward said other one of said electrode plates, said grid members of said other one of said electrode plates staggered relative to said grid members of said one of said electrode plates and projecting outwardly toward said one of said electrode plates for engagement with the opposite side of said membrane element to urge a second portion of said membrane element toward said one of said electrode plates, and a seal means between said plate portions of said electrode plates and said membrane element, said seal means cooperating with said membrane element for establishing a predetermined spacing between said electrode plates.

2. The invention defined in claim 1 wherein said grid members of said electrode plates include curved surface portions for engagement with said membrane element.

3. The invention defined in claim 1 wherein said outer seal members include stiffening elements.

* * * * *